US005750326A

United States Patent [19]

Antoniades et al.

[11] Patent Number: 5,750,326

[45] Date of Patent: May 12, 1998

[54] PROCESS FOR THE PREPARATION OF HIGH BROMIDE TABULAR GRAIN EMULSIONS

[75] Inventors: Michael George Antoniades; Xin Wen, both of Rochester; Mark Jay Herman, Webster, all of N.Y.

[73] Assignee: Eastman Kodak Company, Rochester, N.Y.

[21] Appl. No.: 695,385

[22] Filed: Aug. 9, 1996

[51] Int. Cl.[6] ..... G03C 1/015; G03C 1/035; G03C 1/07

[52] U.S. Cl. ..... 430/568; 430/569; 430/570; 430/599; 430/607

[58] Field of Search ..... 430/567, 568, 430/569, 570, 599, 607

[56] References Cited

U.S. PATENT DOCUMENTS

| | | | |
|---|---|---|---|
| 4,334,012 | 6/1982 | Mignot | 430/567 |
| 4,379,837 | 4/1983 | Lapp et al. | 430/568 |
| 4,439,520 | 3/1984 | Kofron et al. | 430/434 |
| 4,440,463 | 4/1984 | Gliha, Jr. et al. | 339/14 R |
| 4,643,966 | 2/1987 | Maskasky | 430/567 |
| 4,680,254 | 7/1987 | Maskasky | 430/567 |
| 4,680,256 | 7/1987 | Maskasky | 430/567 |
| 4,724,200 | 2/1988 | Maskasky | 430/567 |
| 4,783,398 | 11/1988 | Takada et al. | 430/567 |
| 4,804,621 | 2/1989 | Tufano et al. | 430/567 |
| 4,879,208 | 11/1989 | Urabe | 430/569 |
| 4,952,491 | 8/1990 | Nishikawa et al. | 430/570 |
| 4,983,508 | 1/1991 | Ishiguro et al. | 430/569 |
| 5,004,679 | 4/1991 | Mifune et al. | 430/567 |
| 5,035,991 | 7/1991 | Ichikawa et al. | 430/569 |
| 5,035,992 | 7/1991 | Houle et al. | 430/569 |
| 5,104,785 | 4/1992 | Ichikawa et al. | 430/569 |
| 5,155,017 | 10/1992 | Sato et al. | 430/569 |
| 5,176,991 | 1/1993 | Jones et al. | 430/569 |
| 5,176,992 | 1/1993 | Maskasky | 430/569 |
| 5,178,997 | 1/1993 | Maskasky | 430/569 |
| 5,183,732 | 2/1993 | Maskasky | 430/569 |
| 5,185,239 | 2/1993 | Maskasky | 430/569 |
| 5,196,300 | 3/1993 | Urabe et al. | 430/568 |
| 5,202,226 | 4/1993 | Saitou | 430/569 |
| 5,213,772 | 5/1993 | Ichikawa et al. | 422/245 |
| 5,217,858 | 6/1993 | Maskasky | 430/567 |
| 5,221,602 | 6/1993 | Maskasky | 430/569 |
| 5,238,805 | 8/1993 | Saitou | 430/569 |
| 5,250,403 | 10/1993 | Antoniades et al. | 430/505 |
| 5,252,452 | 10/1993 | Chang et al. | 430/567 |
| 5,254,454 | 10/1993 | Mimiya et al. | 430/569 |
| 5,264,337 | 11/1993 | Maskasky | 430/567 |
| 5,264,338 | 11/1993 | Urabe et al. | 430/568 |
| 5,272,052 | 12/1993 | Maskasky | 430/569 |
| 5,292,632 | 3/1994 | Maskasky | 430/567 |
| 5,298,385 | 3/1994 | Chang et al. | 430/567 |
| 5,298,387 | 3/1994 | Maskasky | 430/569 |
| 5,389,509 | 2/1995 | Maskasky | 430/567 |

FOREIGN PATENT DOCUMENTS

| | | | |
|---|---|---|---|
| 0 503 700 A1 | 9/1992 | European Pat. Off. | G03C 1/07 |

*Primary Examiner*—Mark F. Huff
*Attorney, Agent, or Firm*—Carl O. Thomas

[57] ABSTRACT

A process is disclosed of preparing a high bromide tabular grain emulsion comprising (1) in a grain nucleation step creating in a dispersing medium tabular grain nuclei containing parallel twin planes and (2) in a grain growth step subsequently growing the grain nuclei into tabular grains by running into the dispersing medium high bromide silver halide grains having a maximum equivalent circular diameter of less than 40 nm, wherein (a) the high bromide grains are formed prior to the grain nucleation step and then held in the presence of a grain growth restrainer adsorbed to the grain surfaces to inhibit grain ripening and (b) during the growth step the restrainer is desorbed from the high bromide grains and silver and halide ions forming the high bromide grains are released by ripening into the dispersing medium in the growth step.

7 Claims, 2 Drawing Sheets

PROCESS FOR THE PREPARATION OF HIGH BROMIDE TABULAR GRAIN EMULSIONS

CROSS REFERENCE TO RELATED APPLICATION

Reference is made to and priority claimed from U.S. Provisional application Ser. No. 60/004,529, filed 29 Sep. 1995, entitled PROCESS FOR THE PREPARATION OF HIGH BROMIDE TABULAR GRAIN EMULSIONS.

FIELD OF THE INVENTION

The invention is directed to a process of preparing photographically useful silver halide emulsions.

1. Definition of Terms

As employed herein the term "high bromide" in referring to silver halide grains and emulsions indicates that the halide content is-greater than 50 mole percent bromide, based on total silver.

In referring to silver halide grains and emulsions containing two or more halides the halides are named in order of ascending concentrations.

To be considered "tabular" a grain must have an aspect ratio of at least 2, where the aspect ratio of a grain is the ratio of its equivalent circular diameter to its thickness.

A "tabular grain emulsion" is one in which the tabular grains account for greater than 50 percent of total grain projected area.

*Research Disclosure* is published by Kenneth Mason Publications, Ltd., Dudley House, 12 North St., Emsworth, Hampshire P010 7DQ, England 2. Background The photographic advantages of high bromide tabular grain emulsions were first demonstrated by Wilgus et al U.S. Pat. No. 4,434,226 and Kofron et al U.S. Pat. No. 4,439,520. The high bromide tabular grain emulsions were prepared by creating tabular grain nuclei under a specified set of conditions and then growing these nuclei by the concurrent addition of silver and halide ions.

Among the techniques for tabular grain growth contemplated by Wilgus et al and Kofron et al were those disclosed by Mignot U.S. Pat. No. 4,334,012. Each of Mignot, Wilgus et al and Kofron et al contemplated introducing silver and halide ions during grain growth in the form of preformed grains precipitated immediately prior to delivery to the growth reactor from an upstream nucleation reactor, with recirculation from the growth reactor to the nucleation reactor, which had been long previously practiced, or without recirculation, allowing precipitation in the upstream reactor to be independent of the growth reactor.

Subsequently the term "dual zone" was adopted to indicate precipitation in a growth reactor using for tabular grain growth silver and halide ions delivered to the growth reactor in the form of fine grains precipitated in an upstream reactor immediately prior to delivery to the growth reactor and without prior contact with the contents of the growth reactor. A number of patents have issued subsequently purporting to have discovered the dual zone process in whole or in part, as illustrated by Urabe U.S. Pat. No. 4,879,208, Mifune et al U.S. Pat. No. 5,004,679, Ichikawa et al U.S. Pat. Nos. 5,035,991, 5,104,785 and 5,213,772, Sato U.S. Pat. No. 5,155,107, Saitou U.S. Pat. Nos. 5,202,226 and 5,238,805, and Mimiya et al U.S. Pat. No. 5,254,454.

Dual zone precipitations eliminate the localized supersaturations that occur when soluble silver and halide salts are run directly into the growth reactor. In tabular grain emulsion precipitation dual zone precipitation produces thinner and more uniform tabular grain populations. A most impressive demonstration of the capabilities of dual zone precipitation is provided by Antoniades et al U.S. Pat. No. 5,250,403, which succeeded in preparing high bromide tabular grain emulsions in which ultrathin (<0.07 μm) tabular grains account for greater than 97 percent of total grain projected area while maintaining low overall coefficients of variation of grain size.

Notwithstanding the demonstrated capabilities of dual zone precipitation processes to maximize desired grain parameters in high bromide tabular grain emulsions, the process itself has exhibited a variety of unattractive manufacturing constraints. The first and most fundamental objection to dual zone precipitation has arisen from the added complexity of concurrently operating and controlling two separate reactors. An operator must concurrently monitor the flow rates to the upstream reactor, the contents of the upstream reactor (including temperature, dispersing medium and ion concentrations), the rate of withdrawal from the upstream reactor, and the contents of the growth reactor (including temperature, dispersing medium and ion concentrations). Concurrent operation of both reactors is required, since, if the silver halide grains are not transferred to the downstream growth reactor immediately upon precipitation, nonuniformities in the size and composition of the silver halide grains produced in the upstream reactor result and produce nonuniformities in the final tabular grain emulsion. The process has been further complicated by techniques for improving control of grains produced in the upstream reactor, such as introducing relatively dilute silver and halide jets into the upstream reactor and compensating by conducting ultrafiltration of the contents of the growth reactor.

A variety of organic materials are known that are capable of selectively adsorbing to and thereby restraining deposition of silver halide onto selected crystal faces of silver halide grains. Specific illustrations are provided by Maskasky U.S. Pat. Nos. 4,440,463, 4,643,966, 4,680,254, 4,680,256, 4,724,200, 5,178,997, 5,183,732, 5,185,239, 5,217,858, 5,221,602, 5,272,052, 5,264,337, 5,292,932, 5,298,387, 5,389,509, 5,399,478, 5,411,851, and 5,418,125, Takada et al U.S. Pat. No. 4,783,398, Tufano et al U.S. Pat. No. 4,804,621, Nishikawa et al U.S. Pat. No. 4,952,491, Ishiguro et al U.S. Pat. No. 4,983,508, Houle et al U.S. Pat. No. 5,035,992, Jones et al U.S. Pat. No. 5,176,991, Maskasky et al U.S. Pat. No. 5,176,992, Chang et al U.S. Pat. Nos. 5,252,452 and 5,298,385, and Verbeeck EPO 0 503 700. Sulfur sensitizing compounds, spectral sensitizing dyes, antifoggants and stabilizers are all known to adsorb to silver halide grain surfaces, and examples of such materials are included in the patents noted above.

Borst et al EPO 0 595 031 discloses a process for the preparation an emulsion by adding an emulsion containing more soluble (by reason of size or halide content) silver halide grains to an emulsion containing less soluble grains in the presence of at least two compounds selected from the series of imidazole, histidine (α-amino-β-imidazol-5-yl-propionic acid) or other monocyclic 5- or 6-membered heterocyclic compounds not containing any SH groups but containing at least one ring nitrogen capable of forming hard-to-dissolve silver salts in weakly acid to neutral solutions, which are, however solubilizable in the presence of ammonia at pH >9, wherein at least one of the compounds is imidazole or histidine and at least one other compound is not imidazole or histidine. Examples show the required combination of compounds to produce higher photographic speeds.

SUMMARY OF THE INVENTION

In one aspect the invention is directed to a process of preparing a high bromide tabular grain emulsion comprising (1) in a grain nucleation step creating in a dispersing medium tabular grain nuclei containing parallel twin planes and (2) in a grain growth step subsequently growing the grain nuclei into tabular grains by running into the dispersing medium high bromide silver halide grains having a maximum equivalent circular diameter of less than 40 nm, wherein (a) the high bromide grains are formed prior to the grain nucleation step and then held in the presence of a grain growth restrainer adsorbed to the grain surfaces to inhibit grain ripening and (b) during the growth step the restrainer is desorbed from the high bromide grains and silver and halide ions forming the high bromide grains are released by ripening into the dispersing medium in the growth step.

The process of the invention shares with dual zone precipitation the advantages that flow from avoiding localized silver and halide ion supersaturation levels. Like conventional dual zone reactions in which grain nucleation and growth are conducted simultaneously, the process of the present invention allows excellent control of tabular grain thickness and grain-to-grain uniformity. In addition, the present process simplifies grain preparation by avoiding the concurrent control and monitoring of upstream and downstream reactors. Further, relatively high silver halide concentrations in the upstream reactor are compatible with grain uniformity, thereby avoiding additional complexities, such as conducting ultrafiltration during grain nucleation and tabular grain growth.

PREFERRED EMBODIMENTS

The invention is directed to a novel and advantageous process for preparing high bromide tabular grain emulsions with low levels of silver and halide ion supersaturation. It achieves the same types of grain advantages realizable with a conventional dual zone precipitation process, but with the further advantage of being simpler and more convenient in its operation.

Figure 1:
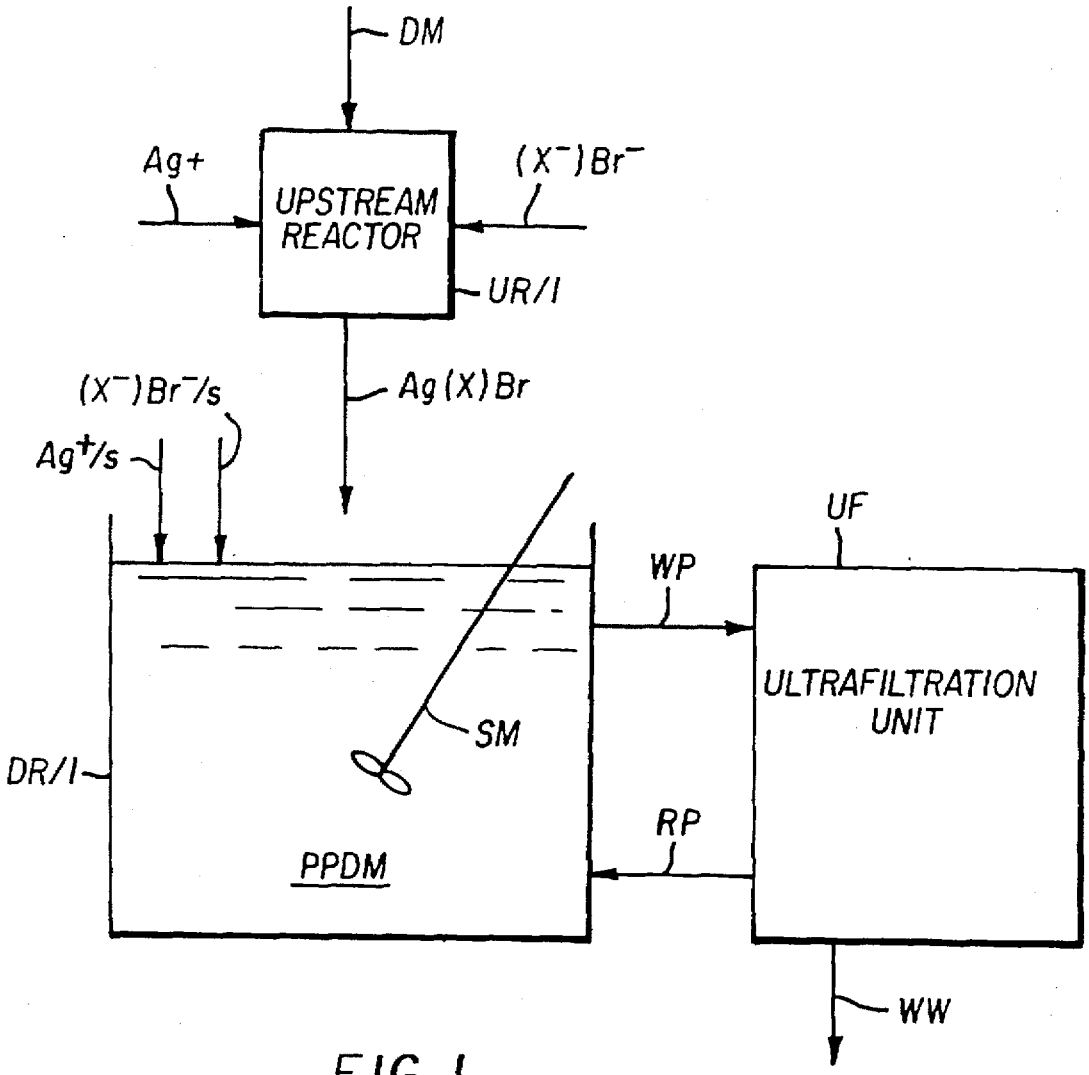
FIG. 1 (prior art)
FIG. 1 is a schematic diagram of a conventional dual zone precipitation arrangement.

The process of the invention can best be appreciated by comparison with a conventional dual zone precipitation arrangement, schematically illustrated in FIG. 1. Aqueous solutions of silver ion $Ag^+$ and halide ion $(X^-)Br^-$ (indicative of >50 M % Br, based on silver; with any additional halide ion $X^-$ being optional) are concurrently introduced, along with an optional separate source of dispersing medium DM, into upstream reactor UR/1 and almost instantaneously delivered as fine (<40 nm maximum grain size) silver (halo)bromide grains Ag(X)Br to downsteam reactor DR/1 containing preprovided dispersing medium PPDM and a stirring mechanism SM.

The supply of reactants to the upstream reactor is adjusted to create fine Ag(X)Br grains containing parallel twin planes. When the first Ag(X)Br fine grains are introduced into the preprovided dispersing medium PPDM, the grains containing parallel twin planes serve as nuclei for the high bromide tabular grains that are ultimately produced. Fine Ag(X)Br grains subsequently delivered from the upstream reactor undergo Ostwald ripening so that the silver and halide ions they contain reenter the dispersing medium in the downstream reactor DR/1 and are redeposited on the tabular grain nuclei.

During precipitation the temperature of each of the upstream and downstream reactors is monitored and controlled. Additionally, silver and reference electrodes, not shown, are used in each of the reactors to monitor and regulate the desired excess of halide ion (e.g., pBr). In the upstream reactor the halide excess is controlled by regulating $Ag^+$ and $(X)Br^-$. In the downstream reactor supplemental aqueous silver $Ag^+$/s and halide $(X^-)Br^-$/s solutions are added as required to shift the halide excess.

Thus, throughout the precipitation, the operator is controlling two concurrently operating reaction vessels. The control complexity is at least twice that of operating a single reactor. In addition, it is quite typical to operate also concurrently an ultrafiltration unit UF that receives emulsion from the downstream reactor, indicated by WP, and returns emulsion to the downstream reactor, indicated by RP, after separating water and soluble salt by-products (e.g., alkali metal and nitrate ions), indicated by WW. One of the reasons for reliance on ultrafiltration is to offset excessive dilution of the tabular grain emulsion being formed, which can in turn be traced to dilution of reactants in the upstream reactor in an effort to avoid nonuniformity (including larger grain sizes) in the Ag(X)Br grain population being produced in the upstream reactor.

Although the process for preparing high bromide tabular grain emulsions of the invention also satisfies, the dual zone process definition, it is in many respects quite different than the typical conventional dual zone precipitation process described above.

Figure 2:
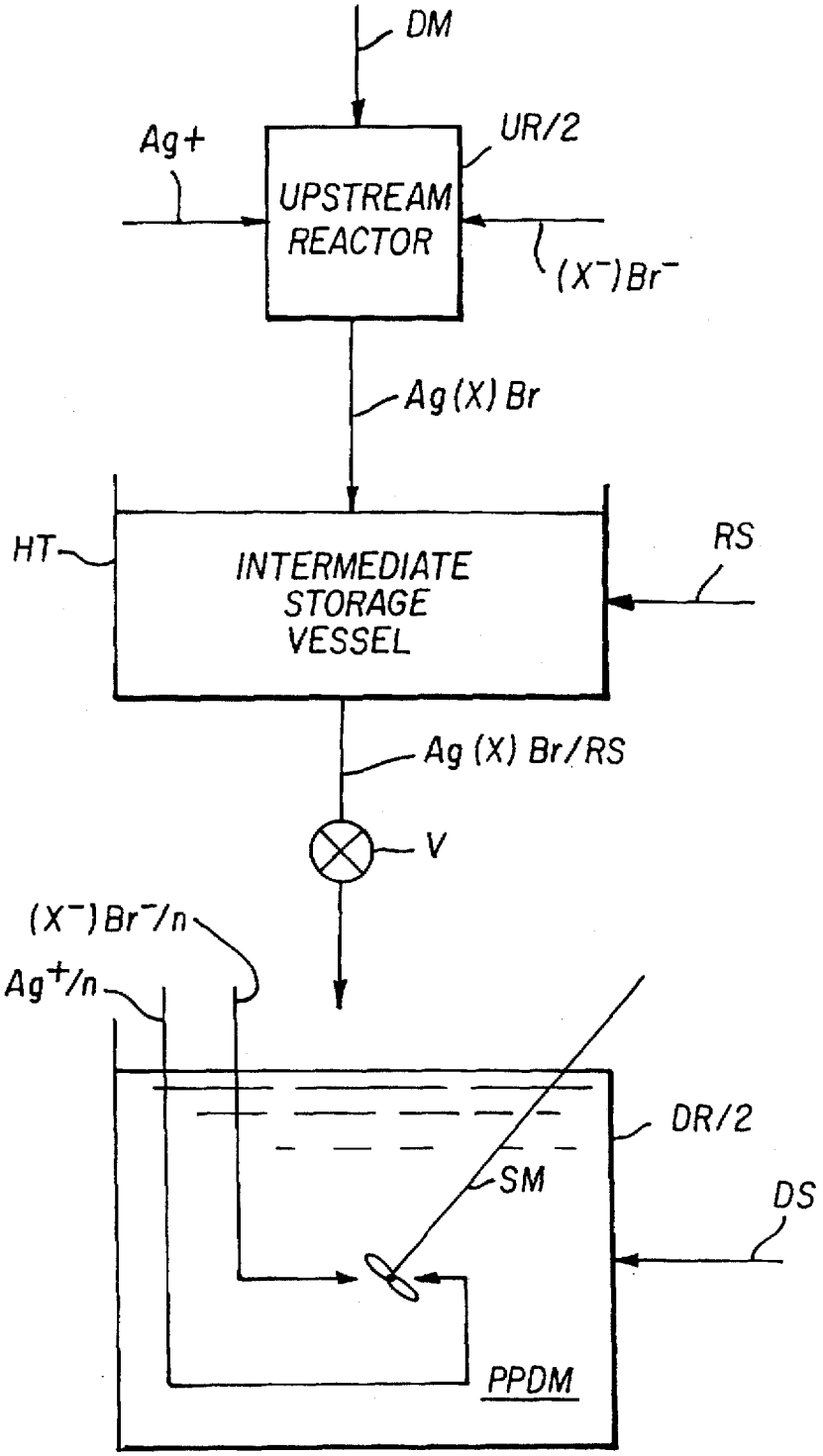
FIG. 2 is a schematic diagram of a dual zone precipitation arrangement modified for practice of the invention.

Referring to FIG. 2, prior to starting operation of the downstream reactor DR/2, the upstream reactor UR/2 is operated by addition of $Ag^+$, DM and $(X^-)Br^-$. These additions can be identical to those employed in the conventional dual zone precipitation of FIG. 1, since the object is shared of creating a high bromide fine grain population with a maximum grain size of less than 40 nm and the most highly uniform grain population attainable. However, a significant difference in the Ag(X)Br grain output of UR/2 is that these fine grains do not form the nuclei of high bromide tabular grains. They are entirely ripened out in the course of tabular grain emulsion preparation. They are used solely for growth of the high bromide tabular grains. Hence, it is unnecessary to choose precipitation conditions to favor the emergence of any particular type of crystal face or crystal irregularity. Specifically, twin plane inclusion is neither necessary nor preferred. In a preferred form the fine grains have no crystal defects intentionally introduced. That is, they are regular grains. They can, for example, be regular cubes, octahedra or tetradecahedra. The advantage of being able to employ regular grains is that this offers the capability of achieving much higher levels of grain uniformity, since techniques for introducing twin planes have never been capable of reliably introducing parallel twin planes in all or even most of the grains precipitated. Tabular grain preparation actually relies upon Ostwald ripening to eliminate grains lacking parallel twin planes. The much broader range of ideal operating conditions available to UR/2 compared to UR/1 in itself represents a significant simplification of the process of preparing high bromide tabular grain emulsions by the dual zone process.

The high bromide fine grain population Ag(X)Br produced by the upstream reactor UR/2 is not immediately transferred to the downstream reactor DR/2. Instead the fine grain population is delivered to an intermediate storage vessel HT. If the high bromide fine grains were simply delivered to the storage vessel HT without taking further precautions, Ostwald ripening of the grains in the storage vessel would begin immediately, so that within a very short period of time the size uniformity of the grains would be degraded and, in the case of mixed halide grains, grain-to-grain halide uniformity would also be degraded.

It is a significant and essential feature of the invention that a grain growth restrainer is adsorbed to the high bromide fine grain surfaces to inhibit grain ripening. The grain growth restrainer can be added along with any one of input streams $Ag^+$, $(X^-)Br^-$ or DM. Alternatively the restrainer can be brought into contact with high bromide fine grains as they are delivered to the intermediate storage vessel. The restrainer can be partially or entirely present in a preprovided portion of the dispersing medium that is present in the intermediate storage vessel prior to receipt of the fine grains. Input of restrainer, indicated at RS, can occur during or immediately following receipt of the fine grains in the intermediate storage vessel. When restrainer is not entirely introduced through the upstream reactor, a preferred arrangement is to place in a preprovided portion of the dispersing medium sufficient restrainer to arrest ripening of the first received fine grains and to thereafter add restrainer, as indicated at RS, during the further course of operation of the upstream reactor. By bringing the fine grains into contact with the restrainer in the intermediate storage vessel rather than in the upstream reactor the risk of introducing fine grain nonuniformities attributable to less than optimum mixing of restrainer in the upstream reactor is avoided.

An optimum approach is to control the concentration of the restrainer so that at the earliest practical moment after their formation the fine grains are in contact with sufficient restrainer to form monolayer coverage by adsorption to the fine grain surfaces. The commonly accepted definition of monolayer coverage is the amount of adsorbate (in this case, restrainer) that, assuming uniform distribution, is just sufficient to entirely cover the surface of the grains. Monolayer coverage can be calculated from the known adsorption displacement ("footprint") of a single restrainer molecule and knowledge of the total grain surface area, calculated from knowledge of the shape and size of the grains. It is usually preferred that something in excess of monolayer coverage of the restrainer be present, typically up to 150 percent of monolayer coverage, since the restrainer may not in all instances be uniformly distributed. However, there is generally no useful purpose to incorporating restrainer in concentrations higher than can be adsorbed to the grain surfaces. Excess, unadsorbed restrainer remains in the dispersing medium. Often the restrainer is effective in somewhat lower than monolayer coverages; however, at least about 80 percent of monolayer coverage is contemplated.

After the high bromide fine grain emulsion Ag(X)Br has been formed and stabilized to inhibit Ostwald ripening by the presence of restrainer RS, operation of the upstream reactor is discontinued. The emulsion is then held for use at a convenient future time. A typical holding period for the fine grain emulsion can range from a few minutes to a few hours to a day or more. In most instances and preferably the entire emulsion preparation process is completed in less than one day.

After the upstream reactor has been shut down, the operator can then turn full attention to the start up and operation of the downstream reactor DR/2. At start up a preprovided dispersing medium PPDM is present in the downstream reactor. Into this dispersing medium aqueous solutions of silver ion $Ag^+/n$ and $(X^-)Br/n$ selected to create a population of tabular grain nuclei containing parallel twin planes are introduced in the vicinity of the stirring mechanism SM. As is well understood in the art, the composition and balance of the aqueous solutions as well as their efficient mixing by the stirring mechanism all play an important role in the efficient incorporation of parallel twin planes in the tabular grain nuclei.

Once the tabular grain nuclei population has been established, introduction of silver and halide ions by $Ag^+/n$ and $(X^-)Br^-/n$ is discontinued, except as desired to adjust the balance of silver and halide ions as precipitation progresses. That is, after tabular grain nucleation the role of $Ag^+/n$ and $(X^-)Br^-/n$ is a supplemental one, similarly as $Ag^+/s$ and $(X^-)Br^-/s$ in FIG. 1, and not the primary source of silver and halide ions for grain growth.

To grow the tabular grain nuclei in the downstream reactor into the desired tabular grain population the halide bromide fine grains with restrainer adsorbed to their surfaces Ag(X)Br/RS are transferred from the intermediate storage vessel HT to the downstream reactor DR/2 by any convenient conventional transfer control mechanism, represented by V. In the simplest form the transfer control mechanism can be a single valve, but in most instances a combination of valves, flow regulators and pumps are employed.

Before the high bromide fine grains can be used for tabular grain growth, the restrainer must be desorbed (removed) from the grain surfaces. This can be accomplished enroute from the intermediate storage vessel to the downstream reactor or in the downstream reactor. In FIG. 2 one alternative, the addition of material to the downstream reactor to promote restrainer desorption, is indicated by DS. For example, restrainer desorption can be accomplished by the addition of a mineral acid (e.g., nitric or hydrochloric acid) to the downstream reactor to protonate the restrainer, thereby increasing its solubility and promoting desorption from the fine grain surfaces. In another approach bromide ion can be introduced through $(X^-)Br^-/n$ to displace restrainer on the fine grain surfaces by competing adsorption. Unlike the restrainer, adsorbed bromide ion does not inhibit the Ostwald ripening required for tabular grain growth.

An important feature of the invention is that when the downstream reactor is in use, the upstream reactor is inactive. Thus, the operator is relieved of concurrently controlling two separate silver halide precipitation reactions, as is required in a conventional dual zone process. As in a simple (single zone) double jet precipitation process, the operator is controlling the temperature and pH of the downstream reactor, monitoring the stoichiometric excess of halide ion using reference and silver ion electrodes, and controlling supplemental silver and/or bromide ion additions to regulate the stoichiometric excess of halide ion.

Ultrafiltration can be performed during operation of the downstream reactor, but this is not required or preferred. The protection of the high bromide fine grains from Ostwald ripening allows the Ag(X)Br/RS emulsion to be more concentrated than the fine grain emulsion delivered from the upstream reactor to the downstream reactor in a conventional dual zone precipitation. Thus, less excess water can be present in the tabular grain emulsion as it is being formed.

The desorbed restrainer along with soluble salts can be washed from the tabular grain emulsion after precipitation is completed employing any convenient conventional washing technique. Such techniques are summarized in *Research Disclosure,* Vol. 365, September 1994, Item 36544, III. Emulsion washing.

As is well understood in the art, emulsion washing is not required, nor does the use of a restrainer during precipitation necessarily require emulsion washing to be undertaken. In many instances the compounds that are useful to inhibit Ostwald ripening are also useful emulsion addenda. Hence, one specifically contemplated alternative is to reverse the desorption of the restrainer after tabular grain growth has been completed so that the restrainer is again adsorbed, but in this instance adsorbed to the surfaces of the tabular grains. The second adsorption can be accomplished merely by reversing the procedure employed to accomplish desorption. For example, if desorption is effected by lowering the pH of the dispersing medium in the downstream reactor, the second adsorption can be accomplished merely by adding a base, such as an alkali hydroxide, to increase pH. The higher pH is capable of deprotonating a restrainer that was initially inactivated and desorbed by protonation. In another approach, where restrainer was forced off the grain surfaces by bromide ion competition, it can be returned merely by lowering the level of excess bromide ion in the dispersing medium (i.e., a conventional pBr adjustment can be undertaken). Where the restrainer is chosen from among the various classes of photographic emulsion compounds known to produce a photographically useful effect when adsorbed, adsorption of the restrainer to the tabular grain surfaces allows the restrainer to serve a second useful purpose. Of course, so long as the restrainer remains on the tabular grain surfaces it also performs the useful function of reducing the risk of inadvertent degradation of tabular grain morphology (e.g., thickness and aspect ratio) in subsequent processing. For example, a tabular grain emulsion heated, as is typically undertaken in chemical sensitization, with restrainer adsorbed to its major faces is much less likely to increase in thickness than a comparable tabular grain lacking a restrainer adsorbed to its major faces.

The formation of a high bromide fine grain emulsion in which the maximum grain size is less than 40 nm (preferably less than 20 nm) can be undertaken by any convenient conventional technique. The high bromide fine grain emulsion can be a silver bromide, chlorobromide, iodobromide, iodochlorobromide or chloroiodobromide emulsion. The bromide content is greater than 50 (preferably greater than 80) mole percent, based on total silver forming the emulsion. The iodide content of the fine grains can range up to saturation levels—e.g., up to approximately 40 mole percent, based on total silver, in a silver iodobromide composition. Preferably the iodide content is less than 20 mole percent and, most commonly less than 10 mole percent, based on total silver. Generally iodide concentrations as low as about 0.1 mole percent, based on total silver, produce demonstrable photographic performance advantages, with minimum iodide concentrations of at least 0.5 mole percent, based on total silver, being preferred for photographic performance advantages, such as an improved speed-granularity relationship, to be realized.

Silver chloride can be present in the high bromide fine grains in concentrations of up to 50 mole percent. Since silver chloride is much more soluble than silver bromide, when equal molar levels of bromide and chloride ions are in solution, much higher levels of bromide than chloride are incorporated into the tabular grains in the downstream reactor. Wey et al U.S. Pat. No. 4,414,306, Table I, compares Cl to Br ion ratios in solution during tabular grain precipitation to those found in the tabular grains precipitated, showing that the ratio of Cl:Br ion in the resulting tabular grains to be much lower than that added to the dispersing medium during precipitation. Delton U.S. Pat. No. 5,372,927 demonstrates that thinner high bromide tabular grains can be produced when from 0.4 to 10 mole percent chloride is present in the dispersing medium during tabular grain growth. Thus, in one preferred form of the invention the high bromide fine grains contain from 0.4 to 10 mole percent chloride, based on total silver, all of this chloride ion being released into the dispersing medium in the downstream reactor.

Subject to the halide ion content and size parameters described above, the high bromide fine grain emulsions can be prepared by any convenient conventional technique. Since high bromide grains when initially formed are well below the maximum permissible size contemplated for the high bromide fine grains, obtaining an emulsion with a maximum grain size of less than 40 nm is easily accomplished merely by terminating precipitation before the 40 nm grain size limit is exceeded. Silver halide precipitation procedures are summarized in *Research Disclosure,* Item 36544, cited above, Section I. Emulsion grains and their properties, C. Precipitation procedures. Specifically contemplated techniques for forming high bromide fine grain populations include those disclosed for use in conventional dual zone precipitations disclosed by Urabe U.S. Pat. No. 4,879,208, Mifune et al U.S. Pat. No. 5,004,679, Ichikawa et al U.S. Pat. Nos. 5,035,991, 5,104,785 and 5,213,772, Sato U.S. Pat. No. 5,155,107, Saitou U.S. Pat. Nos. 5,202,226 and 5,238,805, Mimiya et al U.S. Pat. No. 5,254,454, and Antoniades et al U.S. Pat. No. 5,250,403, the disclosures of which are here incorporated by reference.

It is preferred that relatively high silver halide concentrations be present in the high bromide fine grain emulsions prepared in the upstream reactor UR/2. Specifically, it is preferred that silver halide concentrations be greater than 0.2 mole per liter, most preferably greater than 0.3 mole per liter. Silver halide concentrations in the high bromide fine grain emulsions can range up to 1.0 (preferably 0.5) mole per liter or higher.

The restrainer can take the form of any organic compound that can be easily adsorbed to and desorbed from the high bromide fine grain surfaces. A wide variety of photographically useful compounds commonly incorporated in silver halide emulsions are known to exhibit these characteristics. Such compounds include spectral sensitizing dyes, sulfur sensitizers, antifoggants and stabilizers. Also included are grain growth modifiers, such as those employed to insure the emergence of grain faces of a selected crystallographic orientation. Often a single compound is known to be capable of serving more than one photographic function.

In common structural forms the restrainers are organic compounds comprised of a five or six membered heterocyclic ring containing from one to four heteroatoms, including at least one divalent sulfur atom or one trivalent nitrogen atom. In their active (adsorbed) form none of the ring nitrogen atoms are protonated or quaternized. In addition to the nitrogen and sulfur atoms, which play an active role in promoting adsorption to grain surfaces, the heterocyclic rings typically contain at least one carbon atom and, occasionally, an oxygen atom. The compounds also can (and usually do) include at least one five or six membered ring fused with the heterocyclic ring described above. The fused ring can be either heterocyclic (satisfying the same criteria as the heterocyclic ring described above) or carbocyclic. Ring substituents have a modifying, but secondary effect on adsorption. Many restrainers that adsorb well include an amino and thio (—S—) group present as a heterocyclic ring substituent. Additionally aromatic compounds lacking a heteroatom, but containing a thio or amino ring substituent have been reported to be useful restrainers.

Specific illustrations of restrainers contemplated for use in the practice of the invention are provided in Table I.

TABLE I

| | |
|---|---|
| R-1 | 4-Hydroxy-6-methyl-1,3,3a,7-tetraazaindene |
| R-2 | 5-Bromo-4-hydroxy-6-methyl-1,3,3a,7-tetraazaindene |
| R-3 | 5-Carbethoxy-4-hydroxy-1,3,3a,7-tetraazaindene |
| R-4 | 4-Hydroxy-6-methyl-2-methylmercapto-1,3,3a,7-tetraazaindene |
| R-5 | 7-Ethoxycarbonyl-6-methyl-2-methylthio-4-oxo-1,3,3a,7-tetraazaindene |
| R-6 | 4-Amino-6-methyl-1,3,3a,7-tetraazaindene |
| R-7 | 1-Phenyl-5-mercaptotetrazole |
| R-8 | 1-(3-Acetamidophenyl)-5-mercaptotetrazole |
| R-9 | 1-Ethyl-5-mercaptotetrazole |
| R-10 | 3-Carboxymethyl-5-[1-(2-pyrazolino)cyclopentenylmethylidene]rhodanine |
| R-11 | 5-(3-Ethyl-2-benzothiazolinylidene)-3-β-sulfoethylrhodanine |
| R-12 | 3-Carboxymethyl-5-[2-(3-sulfopropyl)thiazolinylethylidene]rhodanine, sodium salt |
| R-13 | Adenine |
| R-14 | 8-Azaadenine |
| R-15 | Guanine |
| R-16 | Hypoxanthine |
| R-17 | Xanthine |
| R-18 | Pyrimidine |
| R-19 | 4,5,6-Triaminopyrimidine |
| R-20 | 5,6-Diamino-4-(N-methylamino)pyrimidine |
| R-21 | 4,5,6-Tri(N-methylamino)pyrimidine |
| R-22 | 4,6-Diamino-5-(N,N-dimethylaminopyrimidine) |
| R-23 | 4,6-Diamino-5-(N-hexylamino)pyrimidine |
| R-24 | 2,3-Di(carboxymethylthio)-6-methylpyrimidine |
| R-25 | 3-Amino-2-carboxymethylthio-6-hydroxypyrimidine |
| R-26 | 2-(2-carboxyethylamido)-6-methylpyrimidine |
| R-27 | 2-Carboxymethylthio-6-methylpyrimidine |
| R-28 | 6-(N-Methylamino)purine |
| R-29 | 6-(N-Ethylamino)purine |
| R-30 | 6-(N-Butylamino)purine |
| R-31 | 6-Amino-7,8-dihydropurine |
| R-32 | 4-Amino-7,8-dihydropteridine |
| R-33 | 4-Amino-5,8-dihydropteridine |
| R-34 | 4-Amino-5,6,7,8-tetrahydropteridine |
| R-35 | Uric acid |
| R-36 | 6-Benzylaminopurine |
| R-37 | Aniline |
| R-38 | α-Naphthylamine |
| R-39 | β-Naphthylamine |
| R-40 | Benzidine |
| R-41 | Carbazole |
| R-42 | Norharman |
| R-43 | Pyrrole |
| R-44 | Indole |
| R-45 | Pyridine |
| R-46 | 2-Carboxymethylthiopyridine |
| R-47 | Quinoline |
| R-48 | Isoquinoline |
| R-49 | Acridine |
| R-50 | 1,8-Naphthyridine |
| R-51 | 1,10-Phenanthroline |
| R-52 | Benzoxazole |
| R-53 | Pyrazole |
| R-54 | Antipyrine |
| R-55 | Imidazole |
| R-56 | 2-Mercaptoimidazole |
| R-57 | 5-Carboxy-2-carboxymethylthio-4-methylthiazole |
| R-58 | 5-Carboxy-2-methoxycarbonylmethylthio-4-methylthiazole |
| R-59 | 2-Acetamidothiazole |
| R-60 | 4-Carboxyethenyl-2-methylthiazole |
| R-61 | 2-Carboxymethylthiothiazole |
| R-62 | 2-Carboxymethylthio-5-phenyloxadiazole |
| R-63 | Indazole |
| R-64 | Pyrazine |
| R-65 | 2,2'-Bipyrazine |
| R-66 | 1,2,4-Triazine |
| R-67 | 3-Amino-1,2,4-triazole |
| R-68 | 3,5-Diamino-1,2,4-triazole |

TABLE I-continued

| | |
|---|---|
| R-69 | 3-Carboxymethylthio-1,2,4-triazole |
| R-70 | 4-Acetamido-1,2,4-triazole |
| R-71 | 3-Carboxymethylsulfonyl-1,2,4-triazole |
| R-72 | 4-(2-Carboxyethylamido)-3-(ethoxycarbonylmethylthio)-5-methyl-1,2,4-triazole |
| R-73 | 4-Hydroxymethyl-1,2,4-triazole |
| R-74 | 3-(1-Carboxyethylthio)-1,2,4-triazole |
| R-75 | 4-Allyl-3-carboxymethylthio-5-methyl-1,2,4-triazole |
| R-76 | 4-(2,3-Dihydroxypropylsulfonyl)-1,2,4-triazole |
| R-77 | 3-Ethoxycarbonylmethylthio-5-methyl-4-(4-sulfophenylamino)-1,2,4-triazole |
| R-78 | 4-Carboxymethyl-1,2,4-triazole |
| R-79 | 3-Methylthio-5-(2-propyl)-1,2,4-triazole |
| R-80 | 3-(2-Chloroethylamido)-1,2,4-triazole |
| R-81 | 3-(2-Carbamoylethylthio)-1,2,4-triazole |
| R-82 | 1,2,3-Triazole |
| R-83 | Benzotriazole |
| R-84 | 5-Methylbenzotriazole |
| R-85 | 5-Chlorobenzotriazole |
| R-86 | 5-Bromobenzotriazole |
| R-87 | 5-Chloro-8-hydroxy-7-iodoquinoline |
| R-88 | 8-Hydroxy-7-iodo-2-methylquinoline |
| R-89 | 4-Ethyl-8-hydroxy-7-iodoquinoline |
| R-90 | 5,7-Diiodo-8-hydroxyquinoline |
| R-91 | 7-Cyano-8-hydroxy-5-iodoquinoline |
| R-92 | 8-Hydroxy-7-iodo-5-isocyanatoquinoline |
| R-93 | 5-Imino-3-thiourazole |
| R-94 | 7-Azaindole |
| R-95 | 4,7-Diazaindole |
| R-96 | 6,7-Diazaindole |
| R-97 | 4-Azabenzimidazole |
| R-98 | 4-Azabenzotriazole |
| R-99 | 4,7-Diazabenzotriazole |
| R-100 | 1,2,5,7-Tetraazaindene |

The restrainers listed in Table I and other structurally similar restrainers are disclosed by Brooker et al U.S. Pat. No. 2,131,038, Birr et al U.S. Pat. No. 2,152,460, Peterson et al U.S. Pat. No. 2,271,229, Sheppard et al U.S. Pat. No. 2,319,090, Kendall et al U.S. Pat. No. 2,403,927, Dimsdale et al U.S. Pat. No. 2,432,864, Heimbach U.S. Pat. No. 2,444,605, Land U.S. Pat. No. 2,704,721, Hood et al U.S. Pat. No. 2,751,297, Knott et al U.S. Pat. No. 2,933,086, Rauch et al U.S. Pat. No. 3,081,170, Welsh U.S. Pat. No. 3,161,515, Williams U.S. Pat. No. 3,202,512, Weyerts et al U.S. Pat. No. 3,260,597, Kennard et al U.S. Pat. No. 3,266,897, Rogers et al U.S. Pat. No. 3,265,864, von Koenig U.S. Pat. No. 3,364,028, Luckey et al U.S. Pat. No. 3,397,987, Rogers U.S. Pat. No. 3,473,924, Bloom et al 3,575,699, Carlson et al U.S. Pat. No. 3,649,267, Grasshoff et al U.S. Pat. No. 3,674,478, Arond U.S. Pat. No. 3,706,557, Salesin U.S. Pat. No. 3,708,303, Baldassarri et al U.S. Pat. No. 3,925,086, Maskasky U.S. Pat. Nos. 4,440,463, 4,643,966, 4,680,254, 4,680,256, 4,724,200, 5,178,997, 5,183,732, 5,185,239, 5,217,858, 5,221,602, 5,272,052, 5,264,337, 5,292,932, 5,298,387, 5,389,509, 5,399,478, 5,411,851, and 5,418,125, Takada et al U.S. Pat. No. 4,783,398, Tufano et al U.S. Pat. No. 4,804,621, Sakamoto et al U.S. Pat. No. 4,871,658, Nishikawa et al U.S. Pat. No. 4,952,491, Ishiguro et al U.S. Pat. No. 4,983,508, Vetter et al U.S. Pat. No. 5,006,457, Houle et al U.S. Pat. No. 5,035,992, Koide et al U.S. Pat. No. 5,151,357, Kok et al U.S. Pat. No. 5,156,940, Jones et al U.S. Pat. No. 5,176,991, Maskasky et al U.S. Pat. No. 5,176,992, and Chang et al U.S. Pat. Nos. 5,252,452 and 5,298,385, the disclosures of which are here incorporated by reference and also by von Koenig et al U.K. Patent 1,186,441, Verbeeck EPO 0 503 700, Heremans et al EPO 0 528 480, Borst et al EPO 0 595 031 and *Research Disclosure*, Vol. 116, December 1973, Item 11684.

Once the high bromide fine grain emulsion has been prepared and a restrainer has been adsorbed to the grain surfaces, the emulsion can be stored for use at a convenient future time in tabular grain preparation.

Tabular grain nucleation in the downstream reactor can take any convenient conventional form. The techniques for the nucleation and growth of high bromide tabular grain emulsions are illustrated by the following patents, the disclosures of which are here incorporated by reference:

Wilgus et al U.S. Pat. No. 4,434,226;
Kofron et al U.S. Pat. No. 4,439,520;
Daubendiek et al U.S. Pat. No. 4,414,310;
Solberg et al U.S. Pat. No. 4,433,048;
Yamada et al U.S. Pat. No. 4,647,528;
Sugimoto et al U.S. Pat. No. 4,665,012;
Daubendiek et al U.S. Pat. No. 4,672,012;
Yamada et al U.S. Pat. No. 4,678,745;
Daubendiek et al U.S. Pat. No. 4,693,964;
Maskasky U.S. Pat. No. 4,713,320;
Nottorf U.S. Pat. No. 4,722,320;
Sugimoto U.S. Pat. No. 4,755,456;
Goda U.S. Pat. No. 4,775,617;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Antoniades et al U.S. Pat. No. 5,250,403;
Black et al U.S. Pat. No. 5,334,495;
Chaffee et al U.S. Pat. No. 5,358,840;
Delton U.S. Pat. No. 5,372,927; and
Fenton et al U.S. Pat. No. 5,476,760.

Once a population of tabular grain nuclei has been formed in the downstream reactor, the further addition of silver and halide ions to grow the nuclei into the desired tabular grain emulsion is accomplished by employing the high bromide fine grains previously formed in the upstream reactor. Most of the patents cited above specifically teach the alternative of employing a high bromide fine grain population to complete tabular grain growth.

The significant difference of the process of the invention is that the restrainer is adsorbed to the surfaces of the high bromide fine grains and must be desorbed to allow tabular grain growth to occur. When the restrainer contains a trivalent nitrogen atom, a preferred technique for desorbing the restrainer from the fine grain surfaces is to protonate the restrainer. This can be accomplished by pH adjustment. When the restrainer is adsorbed to the high bromide fine grain surfaces, a pH higher than that which allows protonation of the restrainer is employed. Subsequently, when desorption of the restrainer is sought, the pH is lowered until the restrainer is protonated. The requirement of operating the upstream and downstream reactors in differing pH ranges poses no difficulty, since silver halide emulsions can be formed within a wide pH range, from greater than 9 to less than 1.5. The optimum pH range from tabular grain growth is in the pH range from about 2 to acid neutrality (7) or slightly higher (≦8.0). An optimum pH range for tabular grain growth, taught by Antoniades et al U.S. Pat. No. 5,250,403, is from 3 to 6. The pH at which protonation of the restrainer occurs differs somewhat from one molecular structure to the next, but can be readily ascertained, if not previously reported, by routine testing. Jones et al U.S. Pat. No. 5,176,991 and Maskasky et al U.S. Pat. No. 5,176,992, the disclosures of which are here incorporated by reference, provide illustrations of protonation of varied types of restrainers within pH ranges useful for silver halide emulsion precipitation.

An alternative technique for desorbing the restrainer is to increase the stoichiometric excess of bromide ion in the dispersing medium. This desorption technique has the advantage that it can be employed whether or not the restrainer contains a trivalent nitrogen atom. That is, it can be employed with protonatable restrainer or it can be used with restrainers, such as those that contain only a divalent sulfur atom, that are not protonatable. The increased excess of bromide ion results in an increased concentration of bromide ion being adsorbed to the grain surfaces in competition with the restrainer. When sufficient restrainer has been displaced by adsorbed bromide ion, grain ripening takes place. Fortuitously, high bromide tabular grain emulsions are precipitated at relatively high levels of bromide ion. Measured in terms of pBr, the negative log of bromide ion activity, tabular grain growth in the pBr range of from 0.6 to 2.2 is taught by Wilgus et al U.S. Pat. No. 4,434,226. (Note that lower pBr numbers indicate higher bromide ion concentrations in the dispersing medium and, as a consequence, adsorbed to the grain surface.) Since the high bromide fine grains need not be tabular, their formation can be undertaken at pBr values at any convenient level higher than employed for tabular grain growth and at which the restrainer is adsorbed to the grain surfaces. For example, in a typical precipitation, restrainer can be adsorbed to the high bromide fine grains in the pBr range of from about 3.0 to 5.0 or higher and then desorbed by bromide ion displacement when pBr is lowered by adding bromide ion to achieve tabular grain growth. The pBr level at which any selected compound is adsorbed or desorbed, if not previously reported, can be established by routine testing.

EXAMPLES

The invention can be further appreciated by reference to the following specific examples:

Examples 1 to 4

These examples demonstrate the utility of a restrainer to inhibit fine grain ripening and control of adsorption (its active or "switched on" mode) and desorption (its inactive or "switched off" mode) of the restrainer by pH adjustment.

Example 1

(A Comparative Example)

Fine Grain Emulsion Preparation: A 3M $AgNO_3$ solution and a 3.05M halide solution containing NaBr and KI (1.5 mol %) were added with agitation to a vessel charged with a 3.8 L solution containing 200 g of gelatin, NaBr to yield a pBr of 2.3, and $HNO_3$ to obtain a 4.5 pH. The flow rate of the silver and halide reactants was 300 mL/min, each, and the duration of the addition was 2 min. During the precipitation the pBr was controlled at 2.3 and the temperature was maintained at 40° C. At the end of the precipitation the pBr and pH were left at 2.3 and 4.5, respectively.

The maximum size of this fine grains was determined to be lower than 40 nm. This emulsion was set aside and was later used for tabular grain growth as described below.

Tabular Grain Nucleation: To a 4.9 L solution containing 10 g of gelatin were added with agitation 25 mL of a 1.5M $AgNO_3$ solution and 25 mL of a 1.53M halide solution containing NaBr and KI (1.5 mol %) at a flow rate of 100 mL/min each. The pBr and pH of the initial solution were 2.3 and 4.5, respectively, and were not significantly changed during the reactant addition. The temperature was maintained at 40° C. At the end of the reactant addition the pBr was changed to 1.9 with the addition of a 100 mL solution containing NaBr and 4 g of gelatin. The temperature was then increased to 70° C. over a period of 6 min. This procedure yielded tabular grain nuclei.

Tabular Grain Growth: The tabular grain nuclei produced above were grown by the addition of the previously prepared fine grain emulsion. Due to the smaller size of these grains they dissolve due to Ostwald ripening, thus providing growth species for the tabular grain growth. The fine grain emulsion was added at a linearly increased flow rate of 39 mL/min to 150 mL/min over a period of 30 min, then at a linearly increased flow rate of 150 to 190 mL/min over a period of 12 min, and then at a constant flow rate of 190 mL/min until all the fine grain emulsion was used. During this addition the pBr was controlled at 1.9 by the addition of a NaBr solution (1N), the pH was kept at 4.5, and the temperature was maintained at 70° C.

Tabular grains were produced by this method with more than 80% of the emulsion projected area being tabular. The mean equivalent circular diameter (ECD) was 1.5 μm, and the average aspect ratio was higher than 20.

The final size of the fine grains remaining at the end of the tabular grain growth was larger than 100 nm, demonstrating that the significant portion of the fine grains had increased in size from below 40 nm to above 100 nm, due to ripening. This increase in size indicates that the propensity for redissolution (elimination by Ostwald ripening) of these fine grains had significantly decreased.

Example 2

(A Comparative Example)

This example was prepared similarly as Example 1, except that the pH of the fine grain emulsion was changed to 7.0 after its preparation. In addition, the pH during the tabular grain growth was also 7.0.

Fine Grain Emulsion Preparation: A 3M $AgNO_3$ solution and a 3.05M halide solution containing NaBr and KI (1.5 mol %) were added with agitation to a vessel charged with a 3.8 L solution containing 200 g of gelatin, NaBr to yield a pBr of 2.3, and $HNO_3$ to obtain a 4.5 pH. The flow rate of the silver and halide reactants was 300 mL/min, each, and the duration of the addition was 2 min. During the precipitation the pBr was controlled at 2.3 and the temperature was maintained at 40° C. At the end of the precipitation the pBr was kept at 2.3 but the pH was changed to 7.0.

The maximum size of the fine grains was determined to be lower than 40 nm. This emulsion was set aside and was later used for tabular grain growth as described below.

Tabular Grain Nucleation: To a 4.9 L solution containing 10 g of gelatin were added with agitation 25 mL of a 1.5M $AgNO_3$ solution and 25 mL of a 1.53M halide solution containing NaBr and KI (1.5 mol %) at a flow rate of 100 mL/min each. The pBr and pH of the initial solution were 2.3 and 4.5, respectively, and were not significantly changed during the reactant addition. The temperature was maintained at 40° C. At the end of the reactant addition the pBr was changed to 1.9 with the addition of a 100 mL solution containing NaBr and 4 g of gelatin. The temperature was then increased to 70° C. over a period of 6 min. At the end of the 6 min temperature increase the pH was changed to 7.0. This procedure yielded tabular grain nuclei.

Tabular Grain Growth: The tabular grain nuclei produced above were grown by the addition of the previously prepared fine grain emulsion. Due to the smaller size of these grains they dissolve due to Ostwald ripening, thus providing growth species for the tabular grain growth. The fine grain emulsion was added at a linearly increased flow rate of 39 mL/min to 150 mL/min over a period of 30 min, then at a linearly increased flow rate of 150 to 190 mL/min over a period of 12 min, and then at a constant flow rate of 190 mL/min until all the fine grain emulsion was used. During this addition the pBr was controlled at 1.9 by the addition of a NaBr solution (1N), the pH was kept at 7.0, and the temperature was maintained at 70° C.

A tabular grain emulsion comparable to that of Example 1 was produced by this method. As in Example 1, the final size of a significant fraction of the fine grains at the end of the tabular grain growth was larger than 100 nm, demonstrating that the fine grains had increased in size from below 40 nm to above 100 nm, due to ripening. This increase in size indicates that the propensity for redissolution of these fine grains had decreased significantly due to ripening.

Example 3

(A Comparative Example)

This example is the same as Example 2, except that a 100 mL solution containing 5 g of the restrainer R-1 was added to the fine grain emulsion after its preparation.

Fine Grain Emulsion Preparation: A 3M $AgNO_3$ solution and a 3.05M halide solution containing NaBr and KI (1.5 mol %) were added with agitation to a vessel charged with a 3.8 L solution containing 200 g of gelatin, NaBr to yield a pBr of 2.3, and $HNO_3$ to obtain a 4.5 pH. The flow rate of the silver and halide reactants was 300 mL/min, each, and the duration of the addition was 2 min. During the precipitation the pBr was controlled at 2.3 and the temperature was maintained at 40° C.

At the end of the precipitation a solution of 5 g of restrainer R-1 in 100 mL of water were added to the resulting fine grain emulsion, and then the pH was changed to 7.0 to activate the restrainer. The pBr was kept at 2.3. The maximum size of the fine grains was determined to be lower than 40 nm. This emulsion was set aside and was later used for tabular grain growth as described below.

Tabular Grain Nucleation: To a 4.9 L solution containing 10 g of gelatin were added with agitation 25 mL of a 1.5M $AgNO_3$ solution and 25 mL of a 1.53M halide solution containing NaBr and KI (1.5 mol %) at a flow rate of 100 mL/min each. The pBr and pH of the initial solution were 2.3 and 4.5, respectively, and were not significantly changed during the reactant addition. The temperature was maintained at 40° C. At the end of the reactant addition the pBr was changed to 1.9 with the addition of a 100 mL solution containing NaBr and 4 g of gelatin. The temperature was then increased to 70° C. over a period of 6 min. At the end of the 6 min temperature increase the pH was changed to 7.0. This procedure yielded tabular grain nuclei.

Tabular Grain Growth: The tabular grain nuclei produced above were grown by the addition of the previously prepared fine grain emulsion. Due to the smaller size of these grains they dissolve due to Ostwald ripening, thus providing growth species for the tabular grain growth. The fine grain emulsion was added at a linearly increased flow rate of 39 mL/min to 150 mL/min over a period of 30 min, then at a linearly increased flow rate of 150 to 190 mL/min over a period of 12 min, and then at a constant flow rate of 190 mL/min until all the fine grain emulsion was used. During this addition the pBr was controlled at 1.9 by the addition of a NaBr solution (1 N), the pH was kept at 7.0, and the temperature was maintained at 70° C.

The maximum size of the fine grains at the end of the tabular grain growth was below 40 nm demonstrating that the restrainer (switched on by the high pH) was effective in dramatically suppressing Ostwald ripening in this fine grain emulsion. The unchanged size of the fine grain emulsion indicates that the propensity for redissolution of the fine grains was unchanged during the course of the tabular grain growth.

However, upon examination of the final emulsion, no tabular grains were observed at the end of the growth step, indicating that the restrainer was interfering with tabular grain growth.

Example 4

This example, which demonstrates the invention, is the same as Example 3, except that during the growth of the tabular grain nuclei with the fine grain emulsion the pH was maintained at 4.5 in order to switch off the restrainer.

Fine Grain Emulsion Preparation: A 3M $AgNO_3$ solution and a 3.05M halide solution containing NaBr and KI (1.5 mol %) were added with agitation to a vessel charged with a 3.8 L solution containing 200 g of gelatin, NaBr to yield a pBr of 2.3, and $HNO_3$ to obtain a 4.5 pH. The flow rate of the silver and halide reactants was 300 mL/min, each, and the duration of the addition was 2 min. During the precipitation the pBr was controlled at 2.3 and the temperature was maintained at 40° C. At the end of the precipitation 5 g of restrainer R-1 in 100 mL of water were added to the resulting fine grain emulsion, and then the pH was changed to 7.0 to activate the restrainer. The pBr was kept at 2.3. The size of this fine grain emulsion was determined to be lower than 40 nm. This emulsion was set aside and was later used for tabular grain growth as described below.

Tabular Grain Nucleation: To a 4.9 L solution containing 10 g of gelatin were added with agitation 25 mL of a 1.5M $AgNO_3$ solution and 25 mL of a 1.53M halide solution containing NaBr and KI (1.5 mol %) at a flow rate of 100 mL/min each. The pBr and pH of the initial solution were adjusted to 2.3 and 4.5 by the addition of NaBr and $HNO_3$, respectively, and were not significantly changed during the reactant addition. The temperature was maintained at 40° C. At the end of the reactant addition the pBr was changed to 1.9 with the addition of a 100 mL solution containing NaBr and 4 g of gelatin. The temperature was then increased to 70° C. over a period of 6 min. This procedure yielded tabular grain nuclei.

Tabular Grain Growth: The tabular grain nuclei produced above were grown by the addition of the previously prepared fine grain emulsion. Due to the smaller size of these grains they dissolve due to Ostwald ripening, thus providing growth species for the tabular grain growth. The fine grain emulsion was added at a linearly increased flow rate of 39 mL/min to 150 mL/min over a period of 30 min, then at a linearly increased flow rate of 150 to 190 mL/min over a period of 12 min, and then at a constant flow rate of 190 mL/min until all the fine grain emulsion was used. During this addition the pBr was controlled at 1.9 by the addition of a NaBr solution (1N) and the pH was maintained at 4.5 by the addition of a 2.5N $HNO_3$ solution. The temperature was maintained at 70° C.

The maximum size of the fine grains at the end of the tabular grain growth was below 40 nm, demonstrating that the restrainer (switched on by high pH) was effective in dramatically suppressing Ostwald ripening in this fine grain emulsion. The unchanged size of the fine grain emulsion indicates that the propensity for redissolution of the fine grains was unchanged during the course of the tabular grain growth.

In addition, a tabular grain population, comparable to that of Example 1 was obtained at the end of the growth step, indicating that the restrainer was switched off at the lower pH during growth.

The results of Examples 1 through 4 are summarized in Table II.

TABLE II

| Example | Level of R-1 (g/Ag mol) | Fine Grain Emul pH | Growth pH | Fine Grain Emul Size at End (nm) | Final Emul Shape |
|---|---|---|---|---|---|
| 1 | none | 4.5 | 4.5 | >100 | Tabular |
| 2 | none | 7.0 | 7.0 | >100 | Tabular |
| 3 | 2.7 | 7.0 | 7.0 | <40 | Tetra-decahedral |
| 4 | 2.7 | 7.0 | 4.5 | <40 | Tabular |

As seen in Table II, comparative Examples 1 and 2, the pH of the fine grain emulsion does not control unwanted increasing sizes of the fine grains by ripening. Also, the pH of the tabular grain emulsion during growth does not alter the final grain shapes obtained. Example 3 shows that compound R-1 can restrain the ripening of the fine grain emulsion, but if not appropriately switched off during the growth of the tabular grains can interfere with tabular grain growth. Only in Example 4 is the ripening growth of the fine grains restrained and tabular grain growth obtained.

Examples 5 to 8

In examples 5 through 8 it is demonstrated how pBr can be used to control the activity of restrainers and switch them on or off.

Example 5

(A Comparative Example)

Fine Grain Emulsion Preparation: A 3M $AgNO_3$ solution and a 3.05M halide solution containing NaBr and KI (1.5 mol %) were added with agitation to a vessel charged with a 3.8 L solution containing 200 g of gelatin, NaBr to yield a pBr of 2.3, and $HNO_3$ to obtain a 4.5 pH. The flow rate of the silver and halide reactants was 300 mL/min, each, and the duration of the addition was 2 min. During the precipitation the pBr was controlled at 2.3 and the temperature was maintained at 40° C. At the end of the precipitation the pBr was changed to 3.3 and the pH was changed to 5.5. The size of this fine grain emulsion was determined to be lower than 40 nm. This emulsion was set aside and was later used for tabular grain growth as described below.

Tabular Grain Nucleation: To a 4.9 L solution containing 10 g of gelatin were added with agitation 25 mL of a 1.5M $AgNO_3$ solution and 25 mL of a 1.53M halide solution containing NaBr and KI (1.5 mol %) at a flow rate of 100 mL/min each. The pBr and pH of the initial solution were 2.3 and 4.5, respectively, and were not significantly changed during the reactant addition. The temperature was maintained at 40° C. At the end of the reactant addition the pBr was changed to 1.9 with the addition of a 100 mL solution containing NaBr and 4 g of gelatin. The temperature was then increased to 70° C. over a period of 6 min. This procedure yielded tabular grain nuclei.

Tabular Grain Growth: The tabular grain nuclei produced above were grown by the addition of the previously prepared fine grain emulsion. The fine grain emulsion was added at a linearly increased flow rate of 39 mL/min to 150 mL/min over a period of 30 min, then at a linearly increased flow rate of 150 to 190 mL/min over a period of 12 min, and then at a constant flow rate of 190 mL/min until all the fine grain emulsion was used. During this addition the pBr was controlled at 1.9 by the addition of a 1N NaBr solution, the pH was kept at 5.5, and the temperature was maintained at 70° C.

A tabular grain emulsion similar to that of Example 1 was produced by this procedure. Because of the lower solubility of silver halide at pBr 3.3, which is the pBr at which the fine grain emulsion was kept in this case, the Ostwald ripening rate of the fine grain emulsion was also lower. However, ripening still occurred in the absence of a restrainer, and the final size of the maximum size of the fine grains at the end of the tabular grain growth was higher than 40 nm.

Example 6

(A Comparative Example)

This example repeated Example 5, except that the pBr during the tabular grain growth was increased to and controlled at 3.3.

Fine Grain Emulsion Preparation: A 3M $AgNO_3$ solution and a 3.05M halide solution containing NaBr and KI (1.5 mol %) were added with agitation to a vessel charged with a 3.8 L solution containing 200 g of gelatin, NaBr to yield a pBr of 2.3, and $HNO_3$ to obtain a 4.5 pH. The flow rate of the silver and halide reactants was 300 mL/min, each, and the duration of the addition was 2 min. During the precipitation the pBr was controlled at 2.3 and the temperature was maintained at 40° C. At the end of the precipitation the pBr was changed to 3.3 and the pH was changed to 5.5. The size of this fine grain emulsion was determined to be lower than 40 nm. This emulsion was set aside and was later used for tabular grain growth as described below.

Tabular Grain Nucleation: To a 4.9 L solution containing 10 g of gelatin were added with agitation 25 mL of a 1.5M $AgNO_3$ solution and 25 mL of a 1.53M halide solution containing NaBr and KI (1.5 mol %) at a flow rate of 100 mL/min each. The pBr and pH of the initial solution were 2.3 and 4.5, respectively, and were not significantly changed during the reactant addition. The temperature was maintained at 40° C. At the end of the reactant addition the pBr was changed to 1.9 with the addition of a 100 mL solution containing NaBr and 4 g of gelatin. The temperature was then increased to 70° C. over a period of 6 min. At the end of the temperature increase the pBr was changed to 3.3 by the addition of a dilute $AgNO_3$ solution. This procedure yielded tabular grain nuclei.

Tabular Grain Growth: The tabular grain nuclei produced above were grown by the addition of the previously prepared fine grain emulsion. The fine grain emulsion was added at a linearly increased flow rate of 39 mL/min to 150 mL/min over a period of 30 min, then at a linearly increased flow rate of 150 to 190 mL/min over a period of 12 min, and then at a constant flow rate of 190 mL/min until all the fine grain emulsion was used. During this addition the pBr was controlled at 3.2 by the addition of a dilute NaBr solution, the pH was kept at 5.5, and the temperature was maintained at 70° C.

A tabular grain emulsion was obtained by this procedure, but due to the higher pBr during growth, this emulsion was smaller that of the previous examples. The mean ECD was 0.8 μm, and the average aspect ratio was higher than 20, with more than 80% of the projected area being tabular. As in Example 5, ripening of the fine grain emulsion occurred in the absence of a restrainer, and the maximum size of the fine grains at the end of the tabular grain growth was higher than 40 nm.

Example 7

(A Comparative Example)

This example repeated Example 6, except that a 100 mL solution containing 5 g of the restrainer R-1 was added to the fine grain emulsion after its preparation.

Fine Grain Emulsion Preparation: A 3M $AgNO_3$ solution and a 3.05M halide solution containing NaBr and KI (1.5 mol %) were added with agitation to a vessel charged with a 3.8 L solution containing 200 g of gelatin, NaBr to yield a pBr of 2.3, and $HNO_3$ to obtain a 4.5 pH. The flow rate of the silver and halide reactants was 300 mL/min, each, and the duration of the addition was 2 min. During the precipitation the pBr was controlled at 2.3 and the temperature was maintained at 40° C. At the end of the precipitation a solution of 5 g of compound R-1 in 100 mL of water were added to the resulting fine grain emulsion, and then the pBr and pH were changed to 3.3 and 5.5, respectively. The size of this fine grain emulsion was determined to be lower than 40 nm. This emulsion was set aside and was later used for tabular grain growth as described below.

Tabular Grain Nucleation: To a 4.9 L solution containing 10 g of gelatin were added with agitation 25 mL of a 1.5M $AgNO_3$ solution and 25 mL of a 1.53M halide solution containing NaBr and KI (1.5 mol %) at a flow rate of 100 mL/min each. The pBr and pH of the initial solution were 2.3 and 4.5, respectively, and were not significantly changed during the reactant addition. The temperature was maintained at 40° C. At the end of the reactant addition the pBr was changed to 1.9 with the addition of a 100 mL solution containing NaBr and 4 g of gelatin. The temperature was then increased to 70° C. over a period of 6 min. At the end of the temperature increase the pBr was changed to 3.3 by the addition of a dilute $AgNO_3$ solution. This procedure yielded tabular grain nuclei.

Tabular Grain Growth: The tabular grain nuclei produced above were grown by the addition of the previously prepared fine grain emulsion. Due to the smaller size of these grains they dissolve due to Ostwald ripening, thus providing growth species for the tabular grain growth. The fine grain emulsion was added at a linearly increased flow rate of 39 mL/m in to 150 mL/min over a period of 30 min, then at a linearly increased flow rate of 150 to 190 mL/min over a period of 12 min, and then at a constant flow rate of 190 mL/min until all the fine grain emulsion was used. During this addition the pBr was controlled at 3.2 by the addition of a dilute NaBr solution, the pH was kept at 5.5, and the temperature was maintained at 70° C.

The maximum size of the fine grains at the end of the tabular grain growth was below 40 nm demonstrating that the restrainer (switched on by the high pH) was effective in dramatically suppressing Ostwald ripening in this fine grain emulsion. The unchanged size of the fine grain emulsion indicates that the propensity for redissolution of the fine grains was unchanged during the course of the tabular grain growth.

However, upon examination of the final emulsion, no tabular grains were observed at the end of the growth step, indicating that the restrainer was interfering with the growth of tabular grains.

Example 8

This example, which demonstrates the invention, repeated Example 7, except that, during the growth of the tabular grain nuclei with the fine grain emulsion, the pBr was maintained at 1.9 in order to switch off the restrainer.

Fine Grain Emulsion Preparation: A 3M $AgNO_3$ solution and a 3.05M halide solution containing NaBr and KI (1.5 mol %) were added with agitation to a vessel charged with a 3.8 L solution containing 200 g of gelatin, NaBr to yield a pBr of 2.3, and $HNO_3$ to obtain a 4.5 pH. The flow rate of the silver and halide reactants was 300 mL/min, each, and the duration of the addition was 2 min. During the precipitation the pBr was controlled at 2.3 and the temperature was maintained at 40° C. At the end of the precipitation a solution of 5 g of compound R-1 in 100 mL of water were added to the resulting fine grain emulsion, and then the pBr and pH were changed to 3.3 and 5.5, respectively. The size of this fine grain emulsion was determined to be lower than 40 nm. This emulsion was set aside and was later used for tabular grain growth as described below.

Tabular Grain Nucleation: To a 4.9 L solution containing 10 g of gelatin were added with agitation 25 mL of a 1.5M $AgNO_3$ solution and 25 mL of a 1.53M halide solution containing NaBr and KI (1.5 mol %) at a flow rate of 100 mL/min each. The pBr and pH of the initial solution were 2.3 and 4.5, respectively, and were not significantly changed during the reactant addition. The temperature was maintained at 40° C. At the end of the reactant addition the pBr was changed to 1.9 with the addition of a 100 mL solution containing NaBr and 4 g of gelatin. The temperature was then increased to 70° C. over a period of 6 min. This procedure yielded tabular grain nuclei.

Tabular Grain Growth: The tabular grain nuclei produced above were grown by the addition of the previously prepared fine grain emulsion. Due to the smaller size of these grains they dissolve due to Ostwald ripening, thus providing growth species for the tabular grain growth. The fine grain emulsion was added at a linearly increased flow rate of 39 mL/min to 150 mL/min over a period of 30 min, then at a linearly increased flow rate of 150 to 190 mL/min over a period of 12 min, and then at a constant flow rate of 190 mL/min until all the fine grain emulsion was used. During this addition the pBr was controlled at 1.9 by the addition of a NaBr solution (1N), the pH was kept at 5.5, and the temperature was maintained at 70° C.

The maximum size of the fine grains at the end of the tabular grain growth was below 40 nm demonstrating that the restrainer (switched on by high pBr) was effective in dramatically suppressing Ostwald ripening in this fine grain emulsion. The controlled maximum grain size of the fine grain emulsion indicated that the propensity for redissolution of the fine grains was unchanged during the course of the tabular grain growth.

Further, a tabular grain emulsion similar to that of Example 1 was obtained at the end of the growth step, indicating that the restrainer was successfully switched off at the lower pBr during growth.

The results of Examples 5 through 8 are summarized in Table III.

TABLE III

| Example | Level of R-1 (g/Ag mol) | Fine Grain Emulsion pBr | Growth pBr | Fine Grain Emul Size at End (nm) | Final Emulsion Shape |
|---|---|---|---|---|---|
| 5 | none | 3.3 | 1.9 | >40 | Tabular |
| 6 | none | 3.3 | 3.2 | >40 | Tabular |
| 7 | 2.7 | 3.3 | 3.2 | <40 | Tetra-decahedral |
| 8 | 2.7 | 3.3 | 1.9 | <40 | Tabular |

As seen in Table III, Examples 5 and 6, the higher pBr of the fine grain emulsion after its preparation decreases, but does not effectively control ripening. Examples 5 and 6 also show that the higher pBr during growth does not prevent a tabular grain population being grown, although it does affect the final size as discussed in Example 6. Example 7 shows that compound R-1 restrained the ripening of the fine grain emulsion, but if not appropriately switched off during the growth of the tabular grains, it interfered with tabular grain growth. Finally, in only Example 8 were the maximum size of the fine grain emulsion maintained below 40 nm with the desired tabular grains also being obtained.

The invention has been described in detail with particular reference to preferred embodiments thereof, but it will be understood that variations and modifications can be effected within the spirit and scope of the invention.

What is claimed is:

1. A process of preparing a high bromide tabular grain emulsion comprising in a grain nucleation step creating in a dispersing medium tabular grain nuclei containing parallel twin planes and in a grain growth step subsequently growing the grain nuclei into tabular grains by running into the dispersing medium high bromide silver halide grains having a maximum equivalent circular diameter of less than 40 nm,

WHEREIN the high bromide grains are formed prior to the grain nucleation step and then held in the presence of a grain growth restrainer adsorbed to the grain surfaces to inhibit grain ripening, the grain growth restrainer containing a trivalent nitrogen atom and during the growth step the restrainer is released from the high bromide grains by protonation of the nitrogen atom and silver and halide ions forming the high bromide grains are released by ripening into the dispersing medium in the growth step.

2. A process according to claim 1 wherein the restrainer includes at least one divalent sulfur atom.

3. A process according to claim 1 wherein the restrainer is capable of performing a photographically useful function after tabular grains are formed and the restrainer is adsorbed to surfaces of the tabular grains following the growth step.

4. A process according to claim 3 wherein the restrainer is an antifoggant.

5. A process according to claim 3 wherein the restrainer is a spectral sensitizing dye.

6. A process according to claim 3 wherein the restrainer is a surface sensitizer.

7. A process according to claim 1 wherein the high bromide emulsion is a silver iodobromide emulsion.

* * * * *